US007762323B2

(12) United States Patent
Frazier

(10) Patent No.: US 7,762,323 B2
(45) Date of Patent: Jul. 27, 2010

(54) COMPOSITE CEMENT RETAINER

(75) Inventor: W. Lynn Frazier, 713 Snug Harbor, Corpus Christi, TX (US) 78409

(73) Assignee: W. Lynn Frazier, Corpus Christi, TX (US)

( * ) Notice: Subject to any disclaimer, the term of this patent is extended or adjusted under 35 U.S.C. 154(b) by 49 days.

(21) Appl. No.: 11/851,520

(22) Filed: Sep. 7, 2007

(65) Prior Publication Data

US 2008/0073074 A1 Mar. 27, 2008

Related U.S. Application Data

(60) Provisional application No. 60/846,984, filed on Sep. 25, 2006.

(51) Int. Cl.
*E21B 33/12* (2006.01)

(52) U.S. Cl. ..... 166/126; 166/133; 166/138; 166/135; 166/142; 166/332.4

(58) Field of Classification Search ..... 166/123, 166/126, 133, 138, 118, 129, 135, 142, 146, 166/185, 194, 216, 332.1, 332.4, 334.1
See application file for complete search history.

(56) References Cited

U.S. PATENT DOCUMENTS

| | | | | |
|---|---|---|---|---|
| 2,368,428 | A | 1/1945 | Saurenman | |
| 3,275,080 | A | 9/1966 | Nelson et al. | |
| 3,289,762 | A | 12/1966 | Schell et al. | |
| 3,289,769 | A | 12/1966 | Nelson et al. | |
| 3,292,707 | A | 12/1966 | Nelson et al. | |
| 3,298,437 | A | 1/1967 | Conrad | |
| 3,298,440 | A * | 1/1967 | Current | 277/340 |
| 3,306,362 | A | 2/1967 | Urbanosky | |
| 3,995,692 | A | 12/1976 | Seitz et al. | |
| 4,151,875 | A | 5/1979 | Sullaway | |
| 4,176,717 | A | 12/1979 | Hix | |
| 4,427,071 | A | 1/1984 | Carmody | |
| 4,444,266 | A | 4/1984 | Pringle | |
| 4,457,376 | A | 7/1984 | Carmody et al. | |
| 4,478,286 | A | 10/1984 | Fineberg | |
| 4,583,596 | A | 4/1986 | Davis | |
| 4,637,468 | A | 1/1987 | Derrick | |
| 4,708,202 | A | 11/1987 | Sukup et al. | |
| 4,784,226 | A | 11/1988 | Wyatt | |
| 4,813,481 | A | 3/1989 | Sproul et al. | |
| 4,834,184 | A * | 5/1989 | Streich et al. | 166/376 |
| 5,012,867 | A | 5/1991 | Kilgore | |
| 5,224,540 | A | 7/1993 | Streich et al. | |

(Continued)

OTHER PUBLICATIONS

Garry Garfield, "Composite Bridge Plug Technique for Multizone Commingled Gas Wells" in Society of Petroleum Engineers Inc., Mar. 24-27, 2001, Oklahoma City, Oklahoma.

*Primary Examiner*—David J Bagnell
*Assistant Examiner*—Elizabeth C Gottlieb
(74) *Attorney, Agent, or Firm*—Edmonds & Nolte, P.C.

(57) ABSTRACT

A downhole plug that can include a body and an element system disposed about the body. The plug can further include a first and second back-up ring member having two or more tapered wedges. The tapered wedges can be at least partially separated by two or more converging grooves. First and second cones can be disposed adjacent the first and second back-up ring members.

14 Claims, 7 Drawing Sheets

U.S. PATENT DOCUMENTS 5,318,131 A 6/1994 Baker
5,390,737 A * 2/1995 Jacobi et al. ..... 166/184
5,540,279 A 7/1996 Branch et al.
5,564,502 A 10/1996 Crow et al.
5,701,959 A 12/1997 Hushbeck et al.
5,819,846 A 10/1998 Bolt, Jr.
5,839,515 A 11/1998 Yuan et al.
5,904,207 A 5/1999 Rubbo et al.
5,924,696 A 7/1999 Frazier
5,984,007 A 11/1999 Yuan et al.
6,131,656 A 10/2000 Jani
6,167,963 B1 1/2001 McMahan et al.
6,196,261 B1 3/2001 Dennistoun
6,220,349 B1 4/2001 Vargus et al.
6,227,299 B1 5/2001 Dennistoun
6,328,112 B1 12/2001 Malone
6,386,288 B1 5/2002 Snider et al.
6,481,496 B1 11/2002 Jackson et al.
6,491,108 B1 12/2002 Slup et al.
6,536,524 B1 3/2003 Snider
6,543,538 B2 4/2003 Tolman et al.
6,561,270 B1 5/2003 Budde
6,575,249 B2 6/2003 Deaton
6,581,681 B1 6/2003 Zimmerman et al.
6,712,153 B2 * 3/2004 Turley et al. ..... 166/387
6,732,803 B2 5/2004 Garcia et al.
6,796,376 B2 9/2004 Frazier
6,808,020 B2 10/2004 Garcia et al.
6,957,699 B2 10/2005 Feluch et al.
6,997,263 B2 2/2006 Campbell et al.
7,086,481 B2 8/2006 Hosie et al.
2002/0125011 A1 9/2002 Snider et al.
2003/0047315 A1 3/2003 Allamon
2004/0177952 A1 9/2004 Turley et al.
2005/0087335 A1 4/2005 Vick, Jr.
2006/0048936 A1 3/2006 Fripp et al.
2006/0070744 A1 4/2006 Smith
2006/0124310 A1 6/2006 Lopez de Cardenas et al.
2006/0124311 A1 6/2006 Lopez de Cardenas et al.

* cited by examiner

COMPOSITE CEMENT RETAINER

REFERENCE TO RELATED APPLICATIONS

This application claims benefit of U.S. Provisional Patent Application having Ser. No. 60/846,984, filed on Sep. 25, 2006, which is incorporated by reference herein.

BACKGROUND OF THE INVENTION

1. Field of the Invention

Embodiments of the present invention generally relate to a composite downhole tool for hydrocarbon production and method for using same. More particularly, embodiments of the present invention generally relate to a composite cement retainer and method for using same.

2. Description of the Related Art

A wellbore is drilled to some depth below the surface to recover hydrocarbons from subterranean formations. The wellbore can be lined with tubulars or casing to strengthen the walls of the borehole. To further strengthen the walls of the borehole, the annular area formed between the casing and the borehole can be filled with cement to permanently set the casing in the wellbore.

Cement is typically pumped from the surface through the casing and forced out from the bottom of the casing and upwardly into the annulus between the casing and the bore hole. To facilitate the cementing process, a float shoe and/or a float collar is inserted in or adjacent the bottom of the casing. The float shoe and/or float collar are essentially check vales which allow the flow of cement from inside of the casing to the annular space between the casing and the borehole and prevent opposite flow therethrough.

Once the float shoe and/or float collar are located at the bottom of the casing, a bottom plug is then pumped through the casing by the cement. After a sufficient amount of cement has been introduced into the casing, a top plug is places on top of the column of cement. The cement that is bound between the top plug and the bottom plug is pumped down the casing, e.g. by drilling mud, until the bottom plug lands on the float shoe and/or float collar. When the bottom plug lands on the float shoe and/or float collar, the pressure on the top plug is increased until a diaphragm in the bottom plug ruptures thereby allowing the cement to pass through the float shoe and/or float collar and flow around the bottom of the casing and upwardly through the annular space between the casing and the wellbore. After the cement has set, the top plug, bottom plug and any cement set in the casing are drilled out to form a clear path through the wellbore.

The valves and cement in the casing are typically destroyed with a rotating milling or drilling device. As the mill contacts the valves and cement, the valves and cement are "drilled up" or reduced to small pieces that are either washed out or simply left at the bottom of the wellbore. The more metal parts making up the valves, the longer the milling operation takes. Metallic components also require numerous trips in and out of the wellbore to replace worn out mills or drill bits. Depending on the types (i.e. hardness) of the metals in the valves, the drilling removal operation can be extremely timely and expensive for a well operator.

Once the casing is set in the wellbore and the float shoe and float collar have been removed from the wellbore, the casing is then perforated to allow production fluid to enter the wellbore and be retrieved at the surface of the well.

During production, tools with sealing capability are typically placed within the wellbore to isolate the production fluid or to manage production fluid flow through the wellbore. The tools, such as plugs or packers for example, typically have external gripping members and sealing members disposed about a body. Such body and gripping members are typically made of metallic components that difficult to drill or mill. The sealing member is typically made of a composite or synthetic rubber material which seals off an annulus within the wellbore to prevent the passage of fluids. The sealing member is compressed, thereby expanding radially outward from the tool to sealingly engage the surrounding casing or tubular. For example, bridge plugs and frac-plugs are placed within the wellbore to isolate upper and lower sections of production zones, and packers are used to seal-off an annulus between two tubulars within the wellbore.

In workover operations, cement retainers or cement retainer plugs are typically used to close leaks or perforated casing. Certain cement retainers have similar external gripping and sealing members to seal and grip the surrounding well bore or casing, and a valve which can be used to open and close off cementing ports. The retainer is run on either a wireline or a tubing string, and the gripping and sealing members are actuated to seal off the annular space within the wellbore between the retainer and the surrounding casing. Cement is then pumped through the tubing string, through the interior of the retainer, and out the cementing ports to repair the surrounding casing. Such retainers are also constructed of metallic components which must be milled or drilled up to remove the retainer from the wellbore once the cementing job is complete.

There is a need, therefore, for a non-metallic plug that can effectively seal off an annulus within a wellbore and is easier and faster to mill. There is also a need for a non-metallic cement retainer that can effectively seal off an annulus for cementing operations and is easier and faster to mill.

SUMMARY OF THE INVENTION

A non-metallic sealing system, tool, cement retainer, and method for using the same are provided. In at least one specific embodiment, the plug includes a body and an element system disposed about the body. The plug further includes a first and second back-up ring member having two or more tapered wedges. The tapered wedges are at least partially separated by two or more converging grooves. First and second cones are disposed adjacent the first and second back-up ring members.

In at least one other specific embodiment, the plug includes a body; an element system disposed about a first end of the body; a first and second back-up ring member having two or more tapered wedges, wherein the tapered wedges are at least partially separated by two or more converging grooves; a first and second cone disposed adjacent the first and second back-up ring members; a collet valve assembly disposed about a second end of the body. The collet valve assembly includes a housing having a first and second shoulder disposed on an inner surface thereof and one or more ports formed therethrough; a collet disposed within the housing, the collet having a body and two or more fingers disposed thereon, the fingers having a first end with an enlarge outer diameter adapted to engage the first shoulder of the housing, wherein the body includes a section having an enlarged outer diameter adapted to engage the second shoulder of the housing.

In at least one specific embodiment, the composite cement retainer includes a housing having a first and second shoulder disposed on an inner surface thereof and one or more ports formed therethrough; and a collet disposed within the housing, the collet having a body and two or more fingers disposed thereon. The fingers include a first end having an enlarged outer diameter adapted to engage the first shoulder of the housing. The body includes a section having an enlarged outer diameter adapted to engage the second shoulder of the housing.

BRIEF DESCRIPTION OF THE DRAWINGS

So that the manner in which the above recited features of the present invention can be understood in detail, a more particular description of the invention, briefly summarized above, can be had by reference to embodiments, some of which are illustrated in the appended drawings. It is to be noted, however, that the appended drawings illustrate only typical embodiments of this invention and are therefore not to be considered limiting of its scope, for the invention can admit to other equally effective embodiments.

DETAILED DESCRIPTION OF THE PREFERRED EMBODIMENT

A detailed description will now be provided. Each of the appended claims defines a separate invention, which for infringement purposes is recognized as including equivalents to the various elements or limitations specified in the claims. Depending on the context, all references below to the "invention" can in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

As used herein, the terms "connect", "connection", "connected", "in connection with", and "connecting" refer to "in direct connection with" or "in connection with via another element or member."

The terms "up" and "down"; "upper" and "lower"; "upwardly" and downwardly"; "upstream" and "downstream"; "above" and "below"; and other like terms as used herein refer to relative positions to one another and are not intended to denote a particular direction or spatial orientation.

Figure 1:
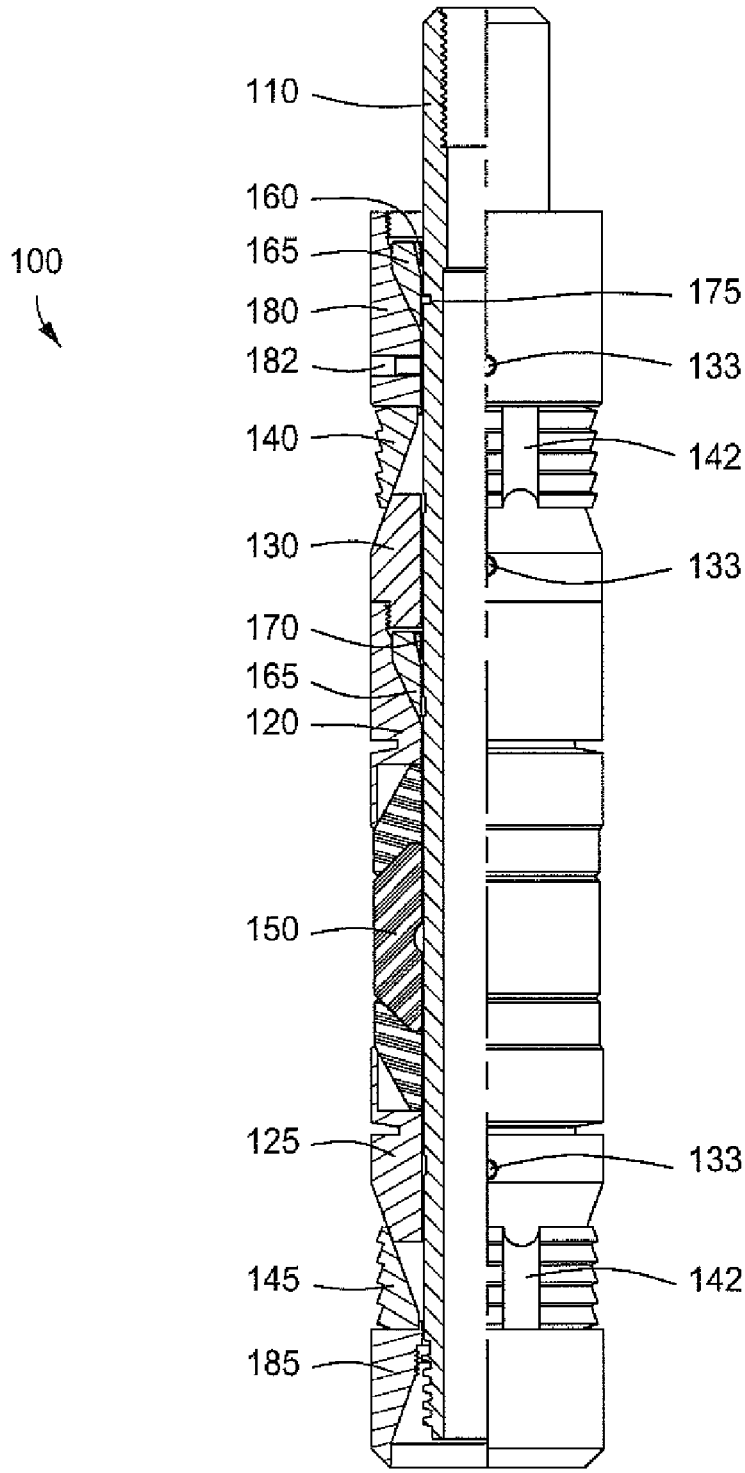
FIG. 1 depicts a partial section view of an illustrative non-metallic, downhole tool in accordance with one or more embodiments described.

In one or more embodiments, a non-metallic sealing system for a downhole tool is provided. FIG. 1 depicts a partial schematic of an illustrative downhole tool in accordance with one or more embodiments described. The non-metallic sealing system can be used on either a metal or more preferably, a non-metallic mandrel or body. The non-metallic sealing system can also be used with a hollow or solid mandrel. For example, the non-metallic sealing system can be used with a bridge plug and frac-plug to seal off a wellbore and the sealing system can be used with a packer to pack-off an annulus between two tubulars disposed in a wellbore.

In one or more embodiments, the downhole tool can be a single assembly (i.e. one tool or plug), as depicted in FIG. 1, or two or more assemblies (i.e. two or more tools or plugs) disposed within a work string or otherwise connected thereto that is run into a wellbore on a wireline, slickline, production tubing, coiled tubing or any technique known or yet to be discovered in the art. For simplicity and ease of description, the tool of the present invention will be further described with reference to a bridge plug 100.

Referring to FIG. 1, the bridge plug 100 includes a mandrel ("body") 110, first and second back-up ring members 120, 125, first and second slip members 140, 145, element system 150, first and second lock rings 160, 170, and support rings 180, 185. Each of the members, rings and elements 120, 125, 140, 145, 150, 160, and 170 are disposed about the body 110. One or more of the body, members, rings, and elements 110, 120, 125, 140, 145, 150, 160, 170, 180, 185 can be constructed of a non-metallic material, preferably a composite material, and more preferably a composite material described herein. In one or more embodiments, each of the members, rings and elements 120, 125, 140, 145, 150, 180, and 185 are constructed of a non-metallic material.

Figure 2:
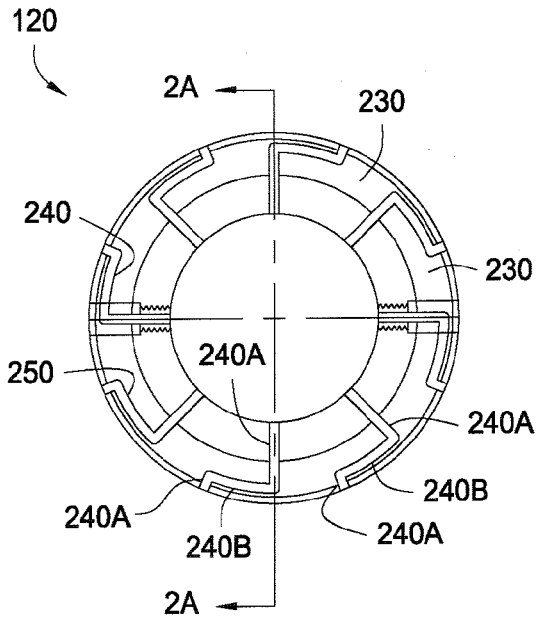
FIG. 2 depicts a plan view of an illustrative back up ring according to one or more embodiments described.
Figure 2A:
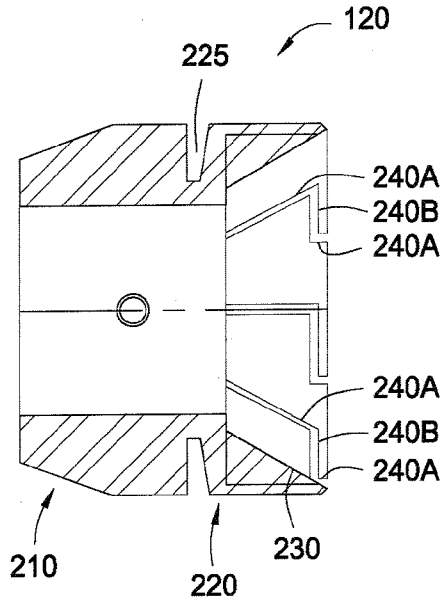
FIG. 2A depicts a cross sectional view of the back up ring shown in FIG. 2 along lines 2A-2A.

FIG. 2 depicts a plan view of an illustrative back up ring member 120, 125 according to one or more embodiments described. FIG. 2A depicts a cross sectional view of the back up ring member 120, 125 shown in FIG. 2 along lines 2A-2A. Referring to FIGS. 2 and 2A, the back up ring member 120, 125 can be and is preferably constructed of one or more non-metallic materials. In one or more embodiments, the back up ring members 120, 125 can be one or more annular members having a first section 210 of a first diameter that steps up to a second section 220 of a second diameter. A recessed groove or void 225 can be disposed or defined between the first and second sections 210. As will be explained in more detail below, the groove or void 225 allows the ring member 120, 125 to expand.

The first section 210 can have a sloped or tapered outer surface as shown. In one or more embodiments, the first section 210 can be a separate ring or component that is connected to the second section 220, as is the first back up ring member 120 depicted in FIG. 1. In one or more embodiments, the first and second sections 210, 220 can be constructed from a single component, as is the second back up ring member 125 depicted in FIG. 1. If the first and second sections 210, 220 are separate components, the first section 210 can be threadably connected to the second section 220. As such, the two non-metallic components (first and second sections 210, 220) are threadably engaged.

In one or more embodiments, the back up ring members 120, 125 can include two or more tapered pedals or wedges 230 (eight are shown in this illustration). The tapered wedges 230 are at least partially separated by two or more converging grooves or cuts 240. The grooves 240 are preferably located in the second section 220 to create the wedges 230 therebetween. The number of grooves 240 can be determined by the size of the annulus to be sealed and the forces exerted on the back up ring 120, 125.

Figure 3:
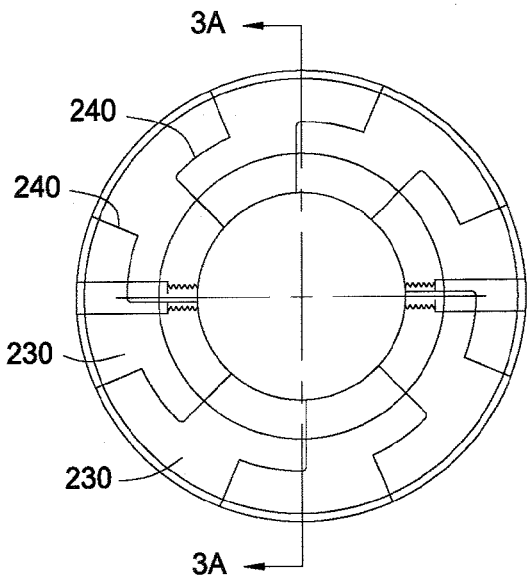
FIG. 3 depicts a plan view of the back up ring of FIG. 2 in an expanded or actuated position.

Considering the grooves 240 in more detail, the grooves 240 each include at least one radial cut or groove 240A and at least one circumferential cut or groove 240B. By "radial" it is meant that the cut or groove traverses a path similar to a radius of a circle. In one or more embodiments, the grooves 240 each include at least two radial grooves 240A and at least one circumferential groove 240B disposed therebetween, as shown in FIGS. 2 and 3. As shown, the circumferential groove 240B intersects or otherwise connects with both of the two radial grooves 240A located at opposite ends thereof.

In one or more embodiments, the intersection of the radial grooves 240A and circumferential grooves 240B form an angle of from about 30 degrees to about 150 degrees. In one or more embodiments, the intersection of the radial grooves 240A and circumferential grooves 240B form an angle of from about 50 degrees to about 130 degrees. In one or more embodiments, the intersection of the radial grooves 240A and circumferential grooves 240B form an angle of from about 70 degrees to about 110 degrees. In one or more embodiments, the intersection of the radial grooves 240A and circumferential grooves 240B form an angle of from about 80 degrees to about 100 degrees. In one or more embodiments, the intersection of the radial grooves 240A and circumferential grooves 240B form an angle of about 90 degrees.

In one or more embodiments, the one or more wedges 230 of the ring member 120, 125 are angled or tapered from the central bore therethrough toward the outer diameter thereof, i.e. the wedges 230 are angled outwardly from a center line or axis of the back up ring 120, 125. Preferably the tapered angle ranges from about 10 degrees to about 30 degrees.

As will be explained below in more detail, the wedges 230 are adapted to hinge or pivot radially outward and/or hinge or pivot circumferentially. The groove or void 225 is preferred to facilitate such movement. The wedges 230 pivot, rotate or otherwise extend radially outward to contact an inner diameter of the surrounding tubular or borehole (not shown). The radial extension increases the outer diameter of the ring member 120, 125 to engage the surrounding tubular or borehole, and provides an increased surface area to contact the surrounding tubular or borehole. Therefore, a greater amount of frictional force can be generated against the surrounding tubular or borehole, providing a better seal therebetween.

In one or more embodiments, the wedges 230 are adapted to extend and/or expand circumferentially as the one or more back up ring members 120, 125 are compressed and expanded. The circumferential movement of the wedges 230 provides a sealed containment of the element system 150 therebetween. The angle of taper and the orientation of the grooves 240 maintain the ring members 120, 125 as a solid structure. For example, the grooves 240 can be milled, grooved, sliced or otherwise cut at an angle relative to both the horizontal and vertical axes of the ring members 120, 135 so that the wedges 230 expand or blossom, remaining at least partially connected and maintain a solid shape against the element system 150 (i.e. provide confinement). Accordingly, the element system 150 is restrained and/or contained by the ring members 120, 125 and not able to leak or otherwise traverse the rings members 120, 125.

Figure 3A:
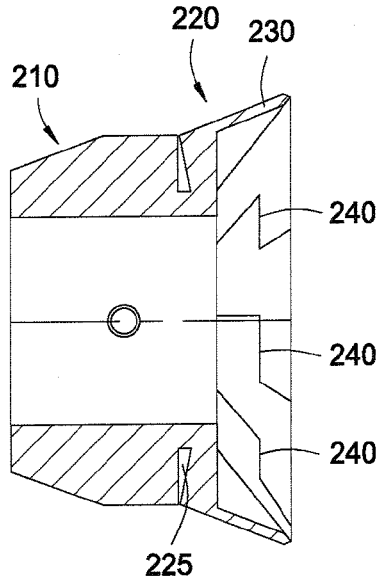
FIG. 3A depicts a cross sectional view of the actuated back up ring shown in FIG. 3 along lines 3A-3A.

FIG. 3 depicts a plan view of the back up ring of FIG. 2 in an expanded or actuated position, and FIG. 3A depicts a cross sectional view of the back up ring shown in FIG. 3 along lines 3A-3A. Referring to FIGS. 3 and 3A, the wedges 230 are adapted to pivot or otherwise move axially within the void 225, thereby hinging the wedges 230 radially and increasing the outer diameter of the ring member 120, 125. The wedges 230 are also adapted to rotate or otherwise move radially relative to one another. Such movement can be seen in this view, depicted by the narrowed space within the grooves 240.

As mentioned above, the back up ring members 120, 125 can be one or more separate components. In one or more embodiments, at least one end of the ring member 120, 125 is conical shaped or otherwise sloped to provide a tapered surface thereon. In one or more embodiments, the tapered portion of the ring members 120, 125 can be a separate cone 130 disposed on the ring member 120, 125 having the wedges 230 disposed thereon, as depicted in FIG. 1 with reference to the ring member 120. The cone 130 can be secured to the body 110 by a plurality of shearable members such as screws or pins (not shown) disposed through one or more receptacles 133.

In one or more embodiments, the cone 130 or tapered member includes a sloped surface adapted to rest underneath a complimentary sloped inner surface of the slip members 140, 145. As will be explained in more detail below, the slip members 140, 145 travel about the surface of the cone 130 or ring member 125, thereby expanding radially outward from the body 110 to engage the inner surface of the surrounding tubular or borehole.

Each slip member 140, 145 can include a tapered inner surface conforming to the first end of the cone 130 or sloped section of the ring member 125. An outer surface of the slip member 140, 145 can include at least one outwardly extending serration or edged tooth, to engage an inner surface of a surrounding tubular (not shown) if the slip member 140, 145 moves radially outward from the body 110 due to the axial movement across the cone 130 or sloped section of the ring member 125.

The slip member 140, 145 can be designed to fracture with radial stress. In one or more embodiments, the slip member 140, 145 can include at least one recessed groove 142 milled therein to fracture under stress allowing the slip member 140, 145 to expand outwards to engage an inner surface of the surrounding tubular or borehole. For example, the slip member 140, 145 can include two or more, preferably four, sloped segments separated by equally spaced recessed grooves 142 to contact the surrounding tubular or borehole, which become evenly distributed about the outer surface of the body 110.

The element system 150 can be one or more separate components. Three components are shown in FIG. 1. The element system 150 can be constructed of any one or more malleable materials capable of expanding and sealing an annulus within the wellbore. The element system 150 is preferably constructed of one or more synthetic materials capable of withstanding high temperatures and pressures. For example, the element system 150 can be constructed of a material capable of withstanding temperatures up to 450° F., and pressure differentials up to 15,000 psi. Illustrative materials include elastomers, rubbers, Teflon®, blend and combinations thereof.

In one or more embodiments, the element system 150 can have any number of configurations to effectively seal the annulus. For example, the element system 150 can include one or more grooves, ridges, indentations, or protrusions designed to allow the element system 150 to conform to variations in the shape of the interior of a surrounding tubular (not shown) or borehole.

Referring again to FIG. 1, the support ring 180 can be disposed about the body 110 adjacent a first end of the slip 140. The support ring 180 can be an annular member having a first end that is substantially flat. The first end serves as a shoulder adapted to abuts a setting tool described below. The support ring 180 can include a second end adapted to abuts the slip 140 and transmit axial forces therethrough. A plurality of pins can be inserted through receptacles 182 to secure the support ring 180 to the body 110.

In one or more embodiments, two or more lock rings 160, 170 can be disposed about the body 110. In one or more embodiments, the lock rings 160, 170 can be split or "C" shaped allowing axial forces to compress the rings 160, 170 against the outer diameter of the body 110 and hold the rings 160, 170 and surrounding components in place. In one or more embodiments, the lock rings 160, 170 can include one or more serrated members or teeth that are adapted to engage the outer diameter of the body 110. Preferably, the lock rings 160, 170 are constructed of a harder material relative to that of the body 110 so that the rings 160, 170 can bite into the outer diameter of the body 110. For example, the rings 160, 170 can be made of steel and the body 110 made of aluminum.

In one or more embodiments, one or more of the lock rings 160, 170 can be disposed within a lock ring housing 165. Both the first and second lock rings 160, 170 are shown in FIG. 1 disposed within a housing 165. In one or more embodiments, the lock ring housing 165 has a conical or tapered inner diameter that complements a tapered angle on the outer diameter of the lock rings 160, 170. Accordingly, axial forces in conjunction with the tapered outer diameter of the lock ring housing 165 urge the lock ring 160, 170 towards the body 110.

Still referring to FIG. 1, the body 110 can include one or more shear points 175 disposed thereon. The shear point 175 is a designed weakness located within the body 110, and is preferably located at an upper portion of the body 110. In one or more embodiments, the shear point 175 can be a portion of the body 110 having a reduced wall thickness, creating a weak or fracture point therein. In one or more embodiments, the shear point 175 can be a portion of the body 110 constructed of a weaker material. The shear point 175 is designed to withstand a predetermined stress and is breakable by pulling and/or rotating the body 110 in excess of that stress.

The plug 100 can be installed in a vertical or horizontal wellbore. The plug 100 can be installed with a non-rigid system, such as an electric wireline or coiled tubing. Any commercial setting tool adapted to engage the upper end of the plug 100 can be used to activate the plug 100 within the wellbore. Specifically, an outer movable portion of the setting tool can be disposed about the outer diameter of the support ring 180. An inner portion of the setting tool can be fastened about the outer diameter of the body 110. The setting tool and plug 100 are then run into the wellbore to the desired depth where the plug 100 is to be installed as shown in FIG. 4.

Figure 4:
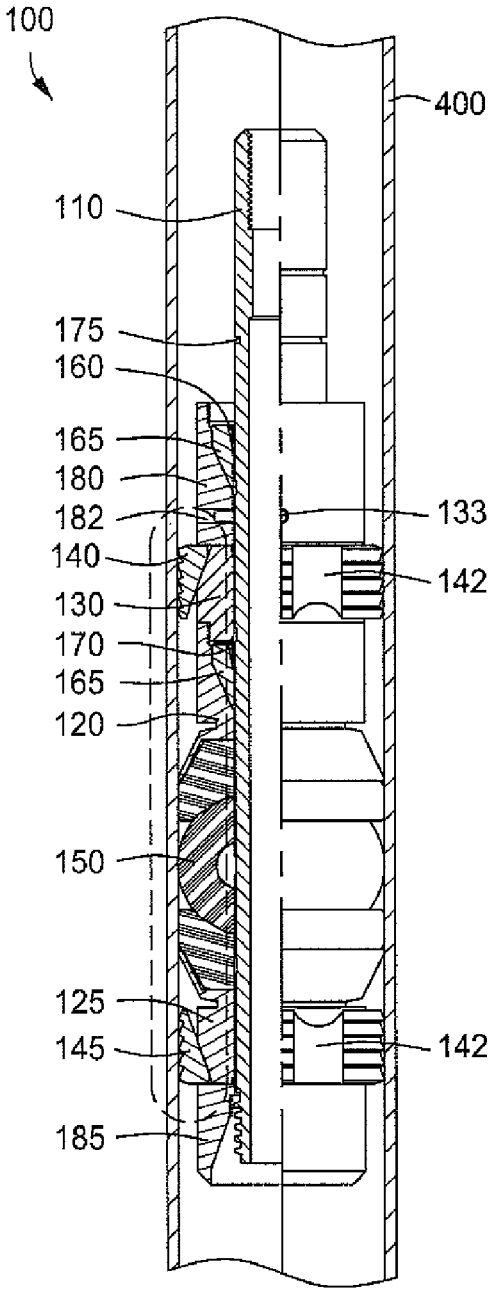
FIG. 4 depicts a partial section view of the plug of FIG. 1 located within a wellbore or borehole.

FIG. 4 depicts an illustrative schematic of the plug 100 located within a well bore 400. To set or activate the plug 100, the body 110 can be held by the wireline, through the inner portion of the setting tool, while an axial force can be applied through a setting tool (not shown) to the support ring 180. The axial forces cause the outer portions of the plug 100 to move axially relative to the body 110.

Figure 5:
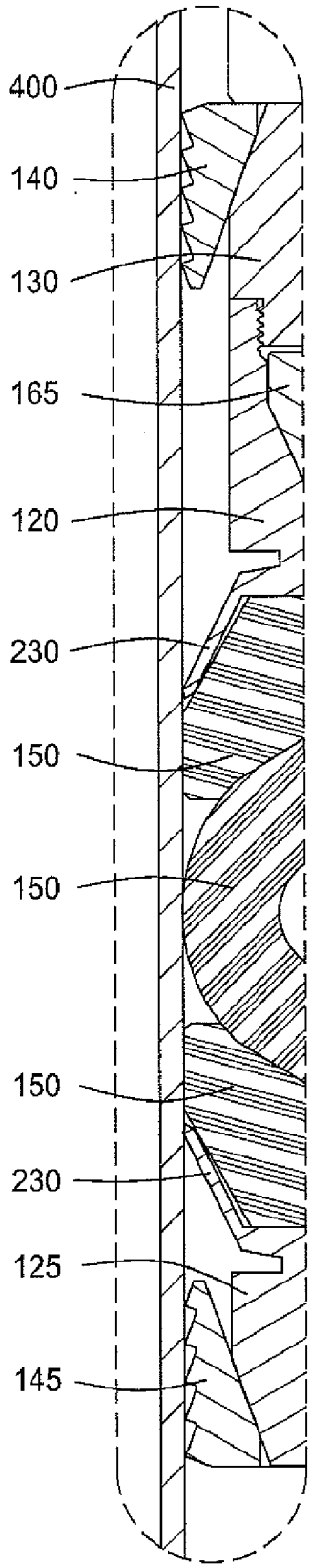
FIG. 5 depicts a partial section view of the plug of FIG. 4 actuated in the wellbore or borehole.

FIG. 5 depicts an illustrative schematic of the plug 100 activated in the well bore 400. As shown, the downward axial force asserted against the support ring 180 and the upward axial force on the body 110 translates the forces to the moveable disposed slip members 140, 145 and back up ring members 120, 125. The slip members 140, 145 move up and across the tapered surfaces of the back up ring members 120, 125 or separate cone 130 and contact an inner surface of a surrounding tubular 400. The axial and radial forces applied to the slip members 140, 145 causes the recessed grooves 142 to fracture into equal segments, permitting the serrations or teeth of the slip members 140, 145 to firmly engage the inner surface of the surrounding tubular 400.

Figure 6:
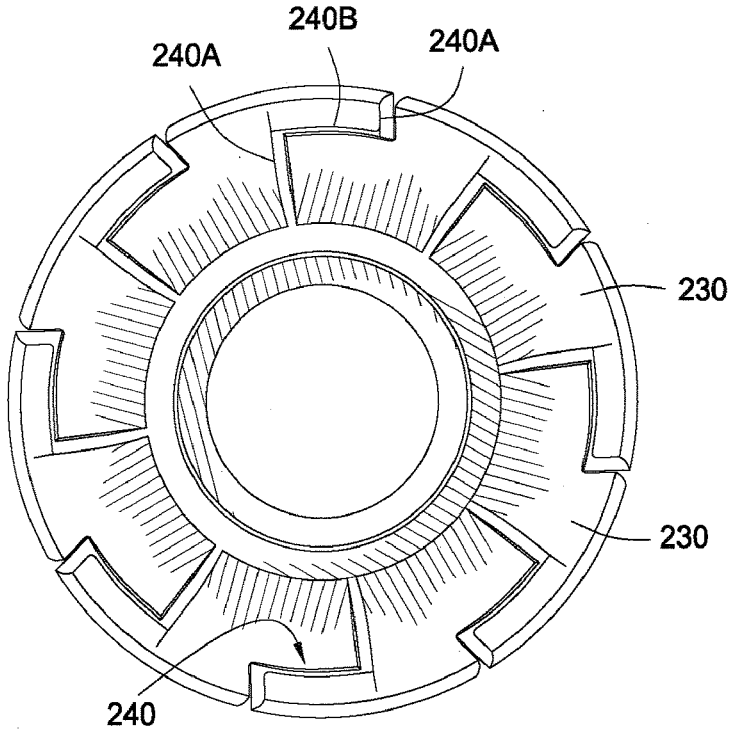
FIG. 6 depicts an illustrative isometric of the back-up ring of FIG. 2 in an expanded or actuated position.

The opposing forces further cause the back-up ring members 120, 125 to move across the tapered sections of the element system 150. As the back-up ring members 120, 125 move axially, the element system 150 expands radially from the body 110 while the wedges 230 hinge radially outward to engage the surrounding tubular 400. The compressive forces cause the wedges 230 to pivot and/or rotate to fill any gaps or voids therebetween and the element system 150 is compressed and expanded radially to seal the annulus formed between the body 110 and the surrounding tubular 400. FIG. 6 depicts an illustrative isometric of the back-up ring members 120, 125 in an expanded or actuated position.

Referring again to FIGS. 4 and 5, the axial movement of the components about the body 110 applies a collapse load on the lock rings 160, 170. The lock rings 160, 170 bit into the softer body 110 and help prevent slippage of the element system 150 once activated. Once activated, the shear point 175 is located above or outside of the components about the body 110. Accordingly, the body 110 can be broken or sheared at the shear point 175 while the activated plug 100 remains in place.

Figure 7:
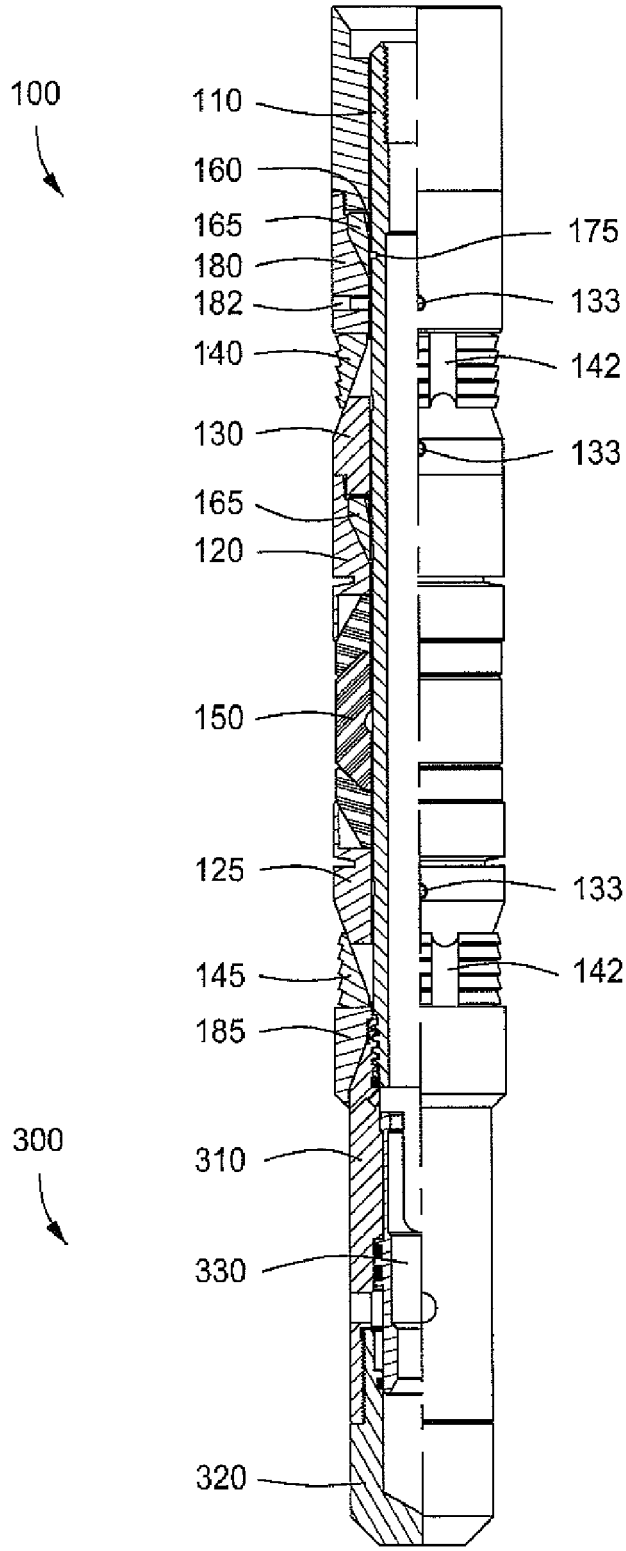
FIG. 7 depicts a partial section view of an illustrative bridge plug having an illustrative collet valve assembly attached thereto, in accordance with one or more embodiments described.
Figure 8:
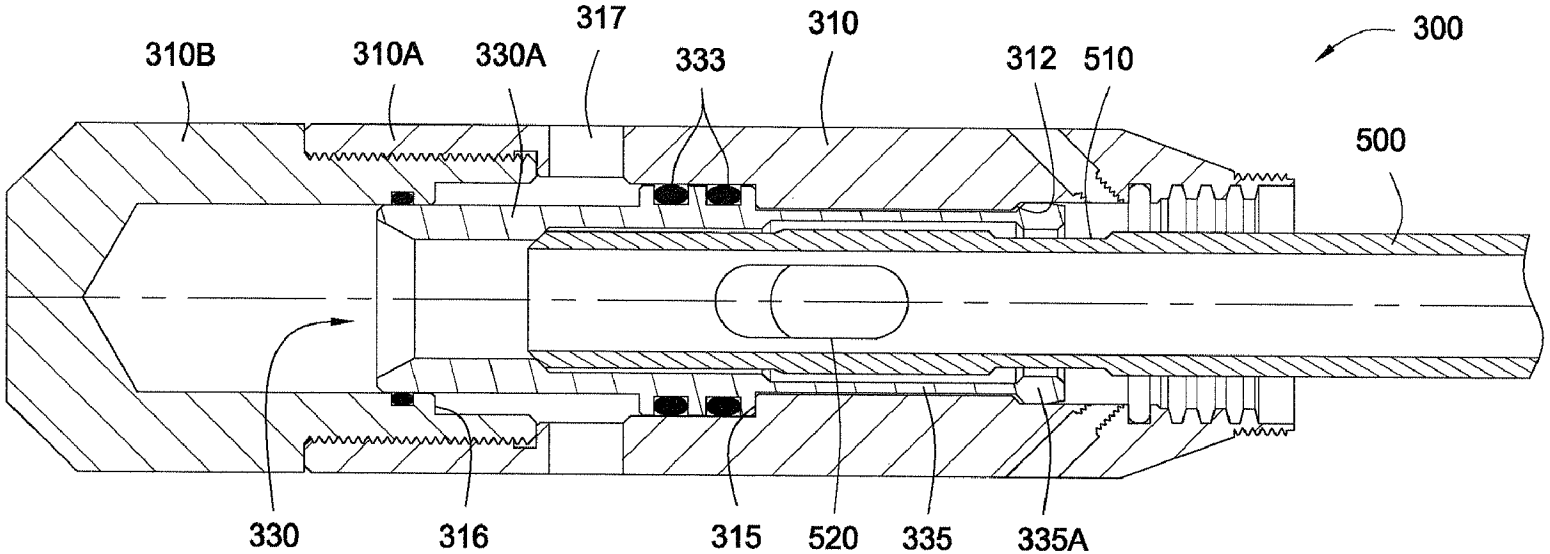
FIG. 8 depicts a partial section view of the collet valve assembly in a closed or run-in position.

FIG. 7 depicts a partial cross sectional view of the illustrative plug 100 having a collet valve assembly 300 attached thereto and FIG. 8 depicts an enlarged partial section view of the collet valve assembly 300. The collet valve assembly 300 is constructed of one or more non-metallic components. In one or more embodiments, the collet valve assembly 300 includes a housing 310 and collet 330. The housing 310 includes a first shoulder 312 and a second shoulder 315 disposed on an inner diameter or surface thereof. In one or more embodiments, the housing 310 includes a third shoulder 316 disposed on an inner diameter or surface thereof. The shoulders 312, 315, 316 can be formed by recessing the inner diameter or inner surface of the housing 310 to form a stepped ledge or support surface. In one or more embodiments, the collet housing 310 includes one or more fluid ports or openings 317 formed therethrough. Two fluid ports 317 are shown in this view.

In one or more embodiments, the housing 310 is a single non-metallic component. In one or more embodiments, the housing 310 is two non-metallic component threadably connected. For examples, the housing 310 can include a first component or section 310A having the one or more ports 317 formed therethrough and a second component or section 320 (i.e. bottom sub assembly) threadably engaged with the first section 310A. The first and second shoulders 312, 315 are preferably disposed within the first section 310A, and the third shoulder 316 disposed within the second section 320. The second section 320 is optional and can be a bottom sub assembly to complete the assembly 300.

In one or more embodiments, an upper end of the collet housing 310 includes a male of female connection. Preferably, the upper end of the collet housing 310 or the first component or section 310A of the collet housing 310 is adapted to threadably engage a plug or other downhole tool, wireline or tubular, including the plug 100 described herein.

Considering the collet 330 in more detail, the collet 330 is housed or disposed within the housing 310 as shown in FIG.

7. If two sections or components are used as the housing 310, the collet 330 can be at least partially housed within the first section 310A of the collet housing 310 and at least partially housed within the second component or section 320.

Figure 8A:
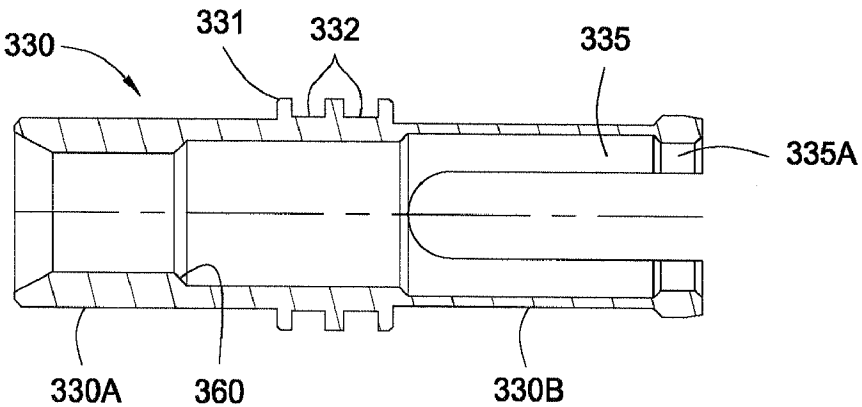
FIG. 8A depicts a section view of the collet shown in FIG. 8. The collet fingers are depicted in an expanded/valve-closed position.

FIG. 8A shows an enlarged cross sectional view of the collet 330 in a closed or run-in position. In one or more embodiments, the collet 330 has a first or lower portion 330A ("body") and a second or upper portion 330B. At least a portion of the body 330A can have an enlarged outer diameter 331 adjacent the upper portion 330B. The enlarged outer diameter 331 preferably includes one more recessed grooves 332 to house one or more o-rings 333 therein. The outer diameter 331 also provides a shoulder or mating surface against shoulder 315 in the housing 310.

In one or more embodiments, a first end or upper portion of the enlarged outer diameter 331 can be adapted to abut the second recessed groove or shoulder 315 in the inner diameter or surface of the housing 310. The mating engagement of the shoulder 315 and the first portion of the enlarged outer diameter 331 prevent the collet 330 from sliding or otherwise exiting the housing 310 in an upward or first axial direction.

A second end or lower portion of the enlarged outer diameter 331 can be adapted to abut the third recessed groove or shoulder 316 in the inner diameter or surface of the housing 310. The mating engagement of the shoulder 316 and the second portion of the enlarged outer diameter 331 prevent the collet 330 from sliding or otherwise exiting the housing 310 in a downward or second axial direction. The third shoulder 316 is primarily to prevent the collet 330 from sliding axially past the ports 317 and opening the valve assembly 300.

Still referring to FIG. 8, the second or upper portion 330B has one or more fingers 335 extending therefrom. Preferably, the collet 330 has two fingers 335 as shown. Preferably, each finger 335 is equally spaced as depicted in FIG. 8A. The ends 335A of the fingers are enlarged to engage the first recessed groove or shoulder 312 formed in the inner surface or diameter of the housing 310. The fingers 335A are biased outward to engage and hold against the shoulder 311.

Figure 9:
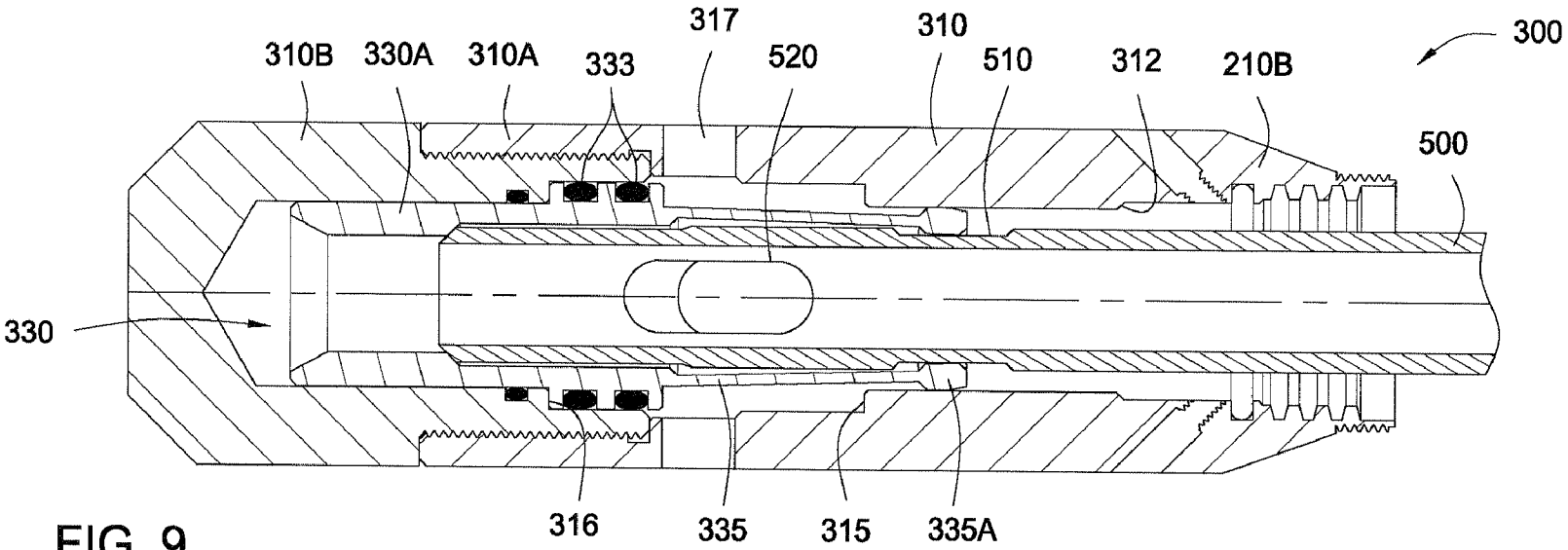
FIG. 9 depicts a partial section view of the collet valve assembly in an open or operating position.
Figure 9A:
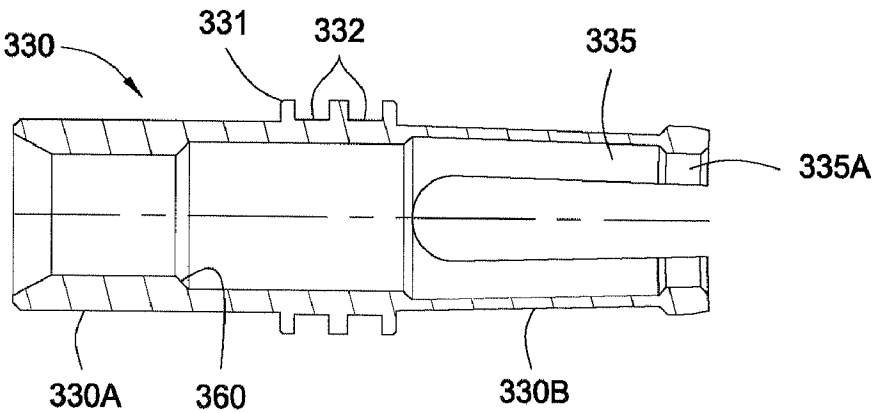
FIG. 9A depicts a section view of the collet shown in FIG. 9. The collet fingers are depicted in a retracted/valve-opened position.

FIG. 9 depicts the collet valve assembly 300 in an open position, and FIG. 9A depicts an enlarged cross sectional view of the collet 330 in a released or open position. As will be explained in more detail below, a separate tool such as a stinger 500 can be inserted through the collet valve assembly 300 and urged against the collet 330 to release the ends 335A from the shoulder 311. As such, the collet 310 is free to move axially within the collet housing 310.

An illustrative stinger 500 is depicted in FIG. 8. In one or more embodiments, the stinger 500 include a recessed groove 510 formed in an outer diameter thereof and one or more openings or ports 520. The stinger is preferably blunt and capped at the bottom end thereof and adapted to engage or otherwise contact an interior of the collet 330. As shown in FIGS. 8 and 8A, the collet 330 can include a seat or mating shoulder 360 having a compatible or matching profile as the end of the stinger 500.

In operation, the plug 100 is run into the wellbore 400 and set as described. At least a portion of the stinger 500 is located through the plug 100 into the cement valve assembly 300 and rested against the seat 360 within the collet 330, as shown in FIG. 8. The stinger 500 is moved axially downward to release the fingers 335 of the collet 330 and move the collet 330 within the housing 310. The fingers 335 release radially inward within the recess 510 formed on the outer surface of the stinger 500. The collet 330 is moved axially until the collet 330 is stopped against the third shoulder 316 of the collet housing 310 as shown in FIG. 9. At this point, the port 520 of the stinger 500 is in fluid communication with the ports 317 in the collet housing 310. One or more fluids can then flow through the stinger 500, out the port 520, through the fingers 335, and into the surrounding tubulars via the assembly ports 317.

As mentioned, any of the components disposed about the body 110, including the body 110, can be constructed of one or more non-metallic or composite materials. In one or more embodiments, the non-metallic or composite materials can be one or more fiber reinforced polymer composites. For example, the polymeric composites can include one or more epoxies, polyurethanes, phenolics, blends thereof and derivatives thereof. Suitable fibers include but are not limited to glass, carbon, and aramids.

In one or more embodiments, the fiber can be wet wound. A post cure process can be used to achieve greater strength of the material. For example, the post cure process can be a two stage cure including a gel period and a cross linking period using an anhydride hardener, as is commonly know in the art. Heat can be added during the curing process to provide the appropriate reaction energy which drives the cross-linking of the matrix to completion. The composite material can also be exposed to ultraviolet light or a high-intensity electron beam to provide the reaction energy to cure the composite material.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A downhole plug, comprising:

a body;

an element system disposed about a first end of the body;

first and second back-up ring members, each having two or more tapered wedges, wherein the tapered wedges are at least partially separated by two or more radial grooves that are offset from one another and disposed about opposite ends of a circumferential groove disposed therebetween, wherein a first radial groove of the first back-up ring member extends to an outer diameter thereof, and a second radial groove of the first back-up ring member extends to an inner diameter thereof;

first and second cones disposed adjacent the first and second back-up ring members;

a collet valve assembly disposed about a second end of the body, the collet valve assembly comprising:

a housing having a first and second shoulders disposed on an inner surface, thereof and one or more ports formed therethrough;

a collet disposed within the housing, the collet having a body and two or more fingers disposed thereon, the fingers having a first end with an enlarged outer diameter adapted to engage the first shoulder of the housing, wherein the body includes a section having an enlarged outer diameter adapted to engage the second shoulder of the housing.

2. The plug of claim 1, wherein the enlarged diameter section of the collet body comprises one or more recessed grooves formed therein, the grooves adapted to house one or more sealable members.

3. The plug of claim 1, wherein the second shoulder is adapted to abut a first end of the enlarged outer diameter section of the collet body.

4. The plug of claim 1, wherein the housing further comprises a third shoulder disposed on the inner surface thereof, the third shoulder adapted to abut a second end of the enlarged outer diameter section of the collet body.

5. The plug of claim 1, wherein the housing comprises a first section having the one or more ports formed therethrough and a second section threadably engaged with the first section.

6. The plug of claim 5, wherein the first and second shoulders are disposed within the first section of the housing.

7. The plug of claim 6, wherein the second section comprises a third shoulder disposed on the inner surface thereof, the third shoulder adapted to abut a second end of the enlarged outer diameter section of the collet body.

8. The plug of claim 7, wherein a first end of the enlarged outer diameter of the collet body is adapted to abut the second shoulder and a second end of the enlarged outer diameter of the collet body is adapted to abut the third shoulder.

9. The plug of claim 1, wherein the element system, first and second back-up ring members, and collet assembly are constructed of a non-metallic material.

10. The plug of claim 1, wherein the circumferential groove of the first back-up ring member is disposed between inner and outer diameters thereof.

11. The plug of claim 1, wherein the circumferential groove of the second back-up ring member is disposed between inner and outer diameters thereof.

12. The plug of claim 1, wherein a first radial groove of the second back-up ring member extends to an outer diameter thereof, and a second radial groove of the second back-up ring member extends to an inner diameter thereof.

13. The plug of claim 1, wherein the circumferential groove is substantially perpendicular to the radial grooves.

14. A downhole plug, comprising:

a body;

an element system disposed about a first end of the body;

at least two back-up ring members, each having two or more tapered wedges, wherein the tapered wedges are at least partially separated by two or more radial grooves that are offset from one another and disposed about opposite ends of a circumferential groove disposed therebetween, and wherein the circumferential groove is disposed between an inner and outer diameter of the back-up ring member and substantially parallel to a perimeter thereof;

first and second cones disposed adjacent the first and second back-up ring members;

a collet valve assembly disposed about a second end of the body, the collet valve assembly comprising:

a housing having a first and second shoulders disposed on an inner surface, thereof and one or more ports formed therethrough;

a collet disposed within the housing, the collet having a body and two or more fingers disposed thereon, the fingers having a first end with an enlarged outer diameter adapted to engage the first shoulder of the housing, wherein the body includes a section having an enlarged outer diameter adapted to engage the second shoulder of the housing.

* * * * *